US010762856B2

(12) United States Patent
Luthra et al.

(10) Patent No.: US 10,762,856 B2
(45) Date of Patent: Sep. 1, 2020

(54) CURRENT PROTECTION SYSTEMS AND METHODS FOR ELECTRONIC DEVICE DISPLAYS

(71) Applicant: Apple Inc., Cupertino, CA (US)

(72) Inventors: Manev Luthra, Cupertino, CA (US); Joseph P. Manca, Sunnyvale, CA (US); Fenghua Zheng, San Jose, CA (US); David S. Zalatimo, San Jose, CA (US)

(73) Assignee: Apple Inc., Cupertino, CA (US)

( * ) Notice: Subject to any disclaimer, the term of this patent is extended or adjusted under 35 U.S.C. 154(b) by 66 days.

(21) Appl. No.: 15/893,317

(22) Filed: Feb. 9, 2018

(65) Prior Publication Data

US 2019/0005897 A1 Jan. 3, 2019

Related U.S. Application Data

(60) Provisional application No. 62/527,965, filed on Jun. 30, 2017.

(51) Int. Cl.
*G09G 3/34* (2006.01)
*G09G 3/36* (2006.01)

(52) U.S. Cl.
CPC ..... *G09G 3/3426* (2013.01); *G09G 3/3614* (2013.01); *G09G 2310/0213* (2013.01); *G09G 2310/0243* (2013.01); *G09G 2320/0295* (2013.01); *G09G 2320/062* (2013.01); *G09G 2320/08* (2013.01); *G09G 2330/04* (2013.01); *G09G 2330/12* (2013.01)

(58) Field of Classification Search
CPC .. G09G 3/34; G09G 3/20; G09G 3/36; G09G 3/3406; G09G 2320/0626; G09G 2330/021; G09G 2360/16
See application file for complete search history.

(56) References Cited

U.S. PATENT DOCUMENTS

| | | | | |
|---|---|---|---|---|
| 6,177,895 | B1 * | 1/2001 | Vrancic | G06J 1/00 341/132 |
| 9,607,561 | B2 * | 3/2017 | Inada | G09G 3/3659 |
| 10,424,239 | B2 * | 9/2019 | Aamold | G09G 3/2007 |
| 2004/0041826 | A1 | 3/2004 | Nakagawa | |
| 2008/0170057 | A1 | 7/2008 | Park et al. | |
| 2010/0253674 | A1 * | 10/2010 | Sugimoto | G09G 3/3233 345/214 |

(Continued)

OTHER PUBLICATIONS

International Search Report and Written Opinion from PCT/US2018/028023, dated Jul. 12, 2018, 17 pages.

*Primary Examiner* — Olga V Merkoulova
(74) *Attorney, Agent, or Firm* — Jaffery Watson Mendonsa & Hamilton LLP

(57) ABSTRACT

Aspects of the subject technology relate to electronic devices with displays. A display may include an array of display pixels and control circuitry for operating the display. The control circuitry may determine, based on pixel values for a row of display pixels, that a current in common supply voltage circuitry for the display pixels will exceed a threshold, if the row of display pixels is operated using the pixel values. The control circuitry may modify the pixel values for the row of display pixels to reduce the current in the common supply voltage circuitry and/or prevent the current in the common supply voltage circuitry from exceeding the threshold.

20 Claims, 9 Drawing Sheets

(56) References Cited

U.S. PATENT DOCUMENTS

| | | | | |
|---|---|---|---|---|
| 2013/0307838 | A1* | 11/2013 | Kim | G09G 5/001 345/212 |
| 2015/0340002 | A1* | 11/2015 | Hu | G09G 3/3607 345/89 |
| 2015/0364088 | A1* | 12/2015 | Zheng | G09G 3/2007 345/690 |
| 2016/0275899 | A1* | 9/2016 | Lin | G09G 3/3696 |
| 2018/0025689 | A1* | 1/2018 | Aamold | G09G 3/2007 345/212 |

* cited by examiner

CURRENT PROTECTION SYSTEMS AND METHODS FOR ELECTRONIC DEVICE DISPLAYS

CROSS-REFERENCE TO RELATED APPLICATIONS

The present application claims the benefit of U.S. Provisional Patent Application Ser. No. 62/527,965, entitled "CURRENT PROTECTION SYSTEMS AND METHODS FOR ELECTRONIC DEVICE DISPLAYS," filed on Jun. 30, 2017, which is hereby incorporated by reference in its entirety for all purposes.

TECHNICAL FIELD

The present description relates generally to electronic device displays, and more particularly, but not exclusively, to control circuitry for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Display control circuitry coupled to the array of display pixels typically receives data for display from system control circuitry of the electronic device and, based on the data for display, generates and provides control signals to the array of display pixels. A common supply voltage is typically provided to the display pixels of the array.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, wearable computing devices, set-top boxes, wireless access points, and other electronic equipment that may include displays. Displays may be used to present visual information and status data and/or may be used to gather user input data. A display may include an array of display pixels. Each display pixel may include one or more colored subpixels for displaying color images.

For example, an electronic device may include a display having an array of display pixels. Each display pixel may include a pixel circuit having components such as thin-film transistors (TFTs) that are operable to control a light-emitting component such as an organic light-emitting diode (OLED) or other light-control components such as a portion of a liquid crystal layer of a display that controls passage of light from a backlight for the display.

A common voltage (VCOM) is supplied to the pixels of the pixel array via VCOM circuitry (e.g., a supply line mesh coupled to all of the pixels of the array). As the display pixels of each row are operated (e.g., illuminated) with differing pixel voltages (to illuminate the display based on different pixel values), the VCOM circuitry sources or sinks current to maintain the common voltage. However, it can be undesirable to have large amounts of current flowing in the VCOM circuitry.

In accordance with various aspects of the subject disclosure, systems and methods for mitigating overcurrent in the VCOM circuitry are provided. For example, and as described in further detail hereinafter, VCOM current may be limited by analyzing the difference in pixel values between each pair of adjacent pixel rows and modifying the values of a current pixel row to prevent row-to-row changes above a threshold.

Figure 1:
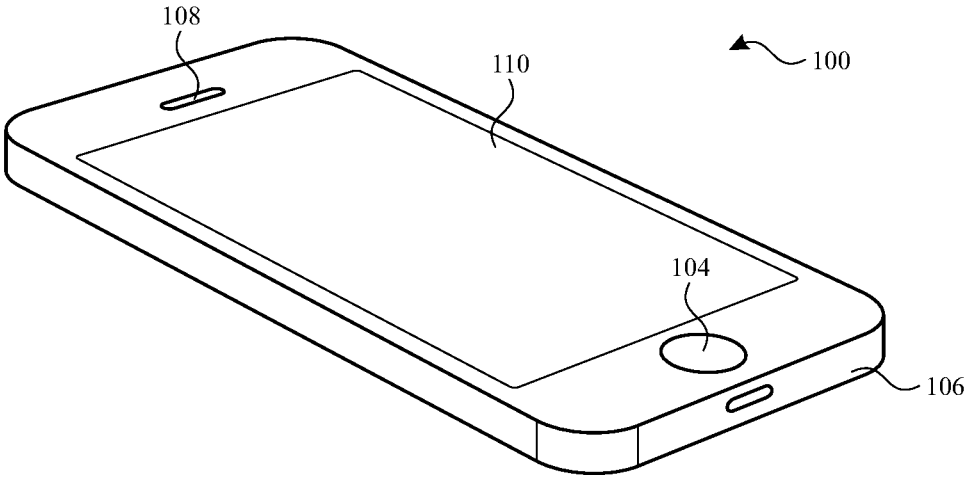
FIG. 1 illustrates a perspective view of an example electronic device implemented as a cellular telephone having a display in accordance with various aspects of the subject technology.

An illustrative electronic device having a display is shown in FIG. 1. In the example of FIG. 1, device 100 has been implemented using a housing that is sufficiently small to fit within a user's hand (e.g., device 100 of FIG. 1 may be a handheld electronic device such as a cellular telephone). As shown in FIG. 1, device 100 includes a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and an opening to accommodate speaker port 108.

Display 110 may be a touch screen that incorporates capacitive touch electrodes or other touch sensor components or may be a display that is not touch-sensitive. Display 110 includes display pixels. The display pixels may be formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using organic light-emitting diode pixels and liquid crystal display pixels are sometimes described herein as an example. This is, however, merely illustrative. In various implementations, any suitable type of display technology may be used in forming display 110, if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a tablet computer, a somewhat smaller portable device such as a wrist-watch device, pendant device, or other wearable or miniature device, a media player, a gaming device, a navigation device, a computer monitor, a television, or other electronic equipment.

Figure 2:
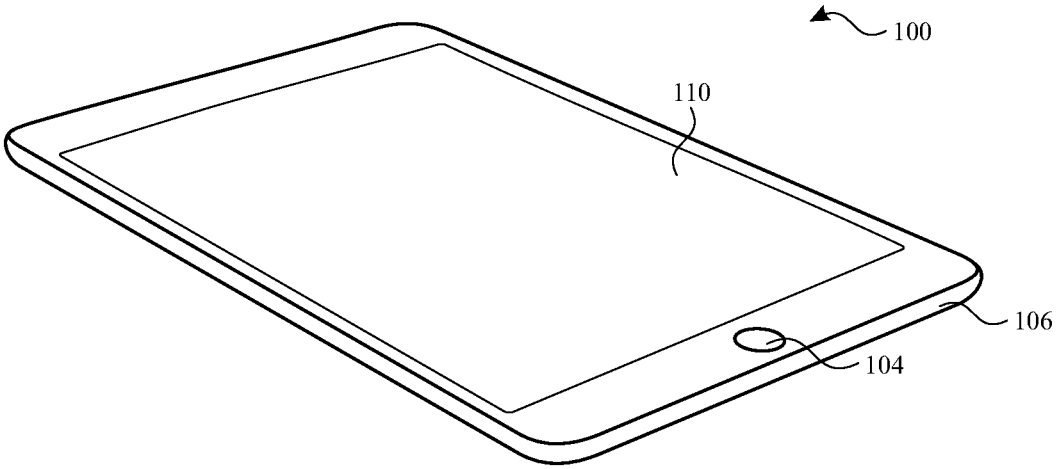
FIG. 2 illustrates a perspective view of an example electronic device implemented as a tablet computer having a display in accordance with various aspects of the subject technology.

For example, FIG. 2 is a perspective view of electronic device 100 in a configuration in which electronic device 100 has been implemented in the form of a tablet computer. In the example of FIG. 2, display 110 is mounted on the upper (front) surface of housing 106. An opening may be formed in display 110 to accommodate button 104.

Figure 3:
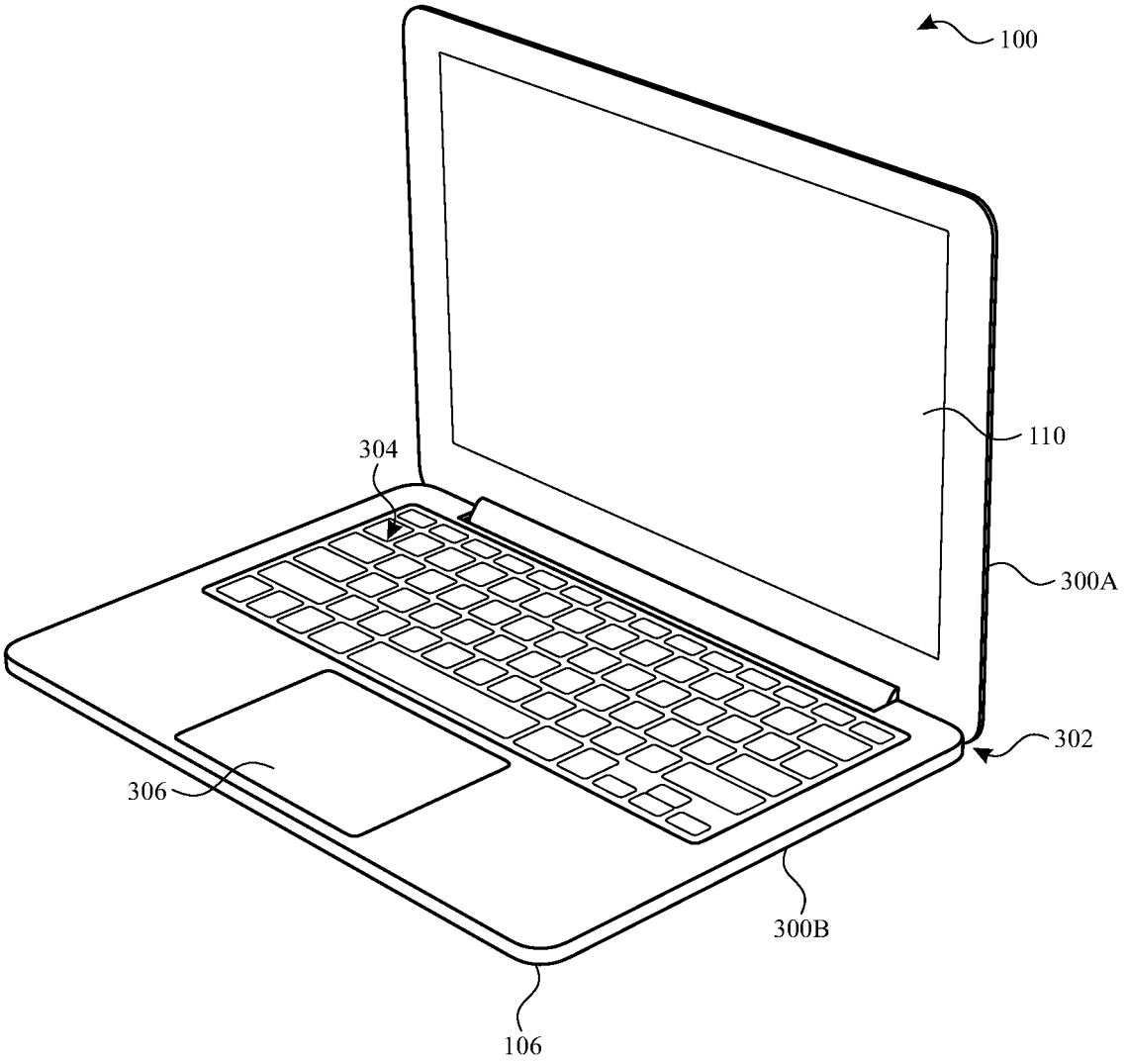
FIG. 3 illustrates a perspective view of an example electronic device implemented as a portable computer having a display in accordance with various aspects of the subject technology.

As another example, FIG. 3 is a perspective view of electronic device 100 in a configuration in which electronic device 100 has been implemented in the form of a portable computer. In the example of FIG. 3, housing 106 may be formed using a unibody configuration in which some or all of housing 106 is machined or molded as a single structure or may be formed using multiple structures (e.g., an internal frame structure, one or more structures that form exterior housing surfaces, etc.).

As shown in FIG. 3, housing 106 may have multiple parts. For example, housing 106 may have upper portion 300A and lower portion 300B. Upper portion 300A may be coupled to lower portion 300B using a hinge that allows portion 300A to rotate about rotational axis 302 relative to portion 300B. A keyboard such as keyboard 304 and a touch pad such as touch pad 306 may be mounted in lower housing portion 300B, in some implementations.

Figure 4:
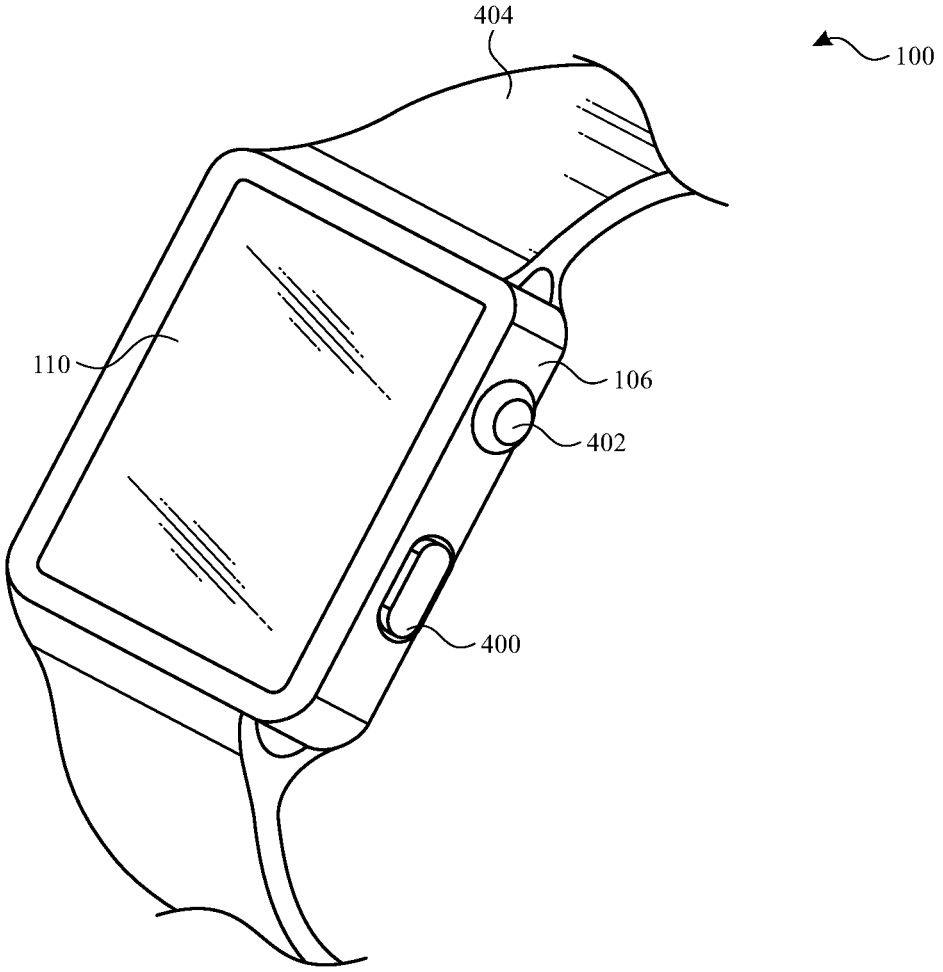
FIG. 4 illustrates a perspective view of an example electronic device implemented as a wearable device having a display in accordance with various aspects of the subject technology.

FIG. 4 is a perspective view of electronic device 100 in a configuration in which electronic device 100 has been implemented in the form of a wearable device such as wristwatch device. In the example of FIG. 4, display 110 is mounted on a front surface of housing 106. Housing 106 may include one or more openings, such as sidewall openings in which one or more corresponding input/output components are disposed. In the example of FIG. 4, a compressible side button 400 and a compressible/rotatable crown button 402 are provided by which a user can operate device 100. Strap 404 may be coupled to housing 106 and arranged to secure device 100 to a part of a user's body such as around the user's wrist.

Figure 5:
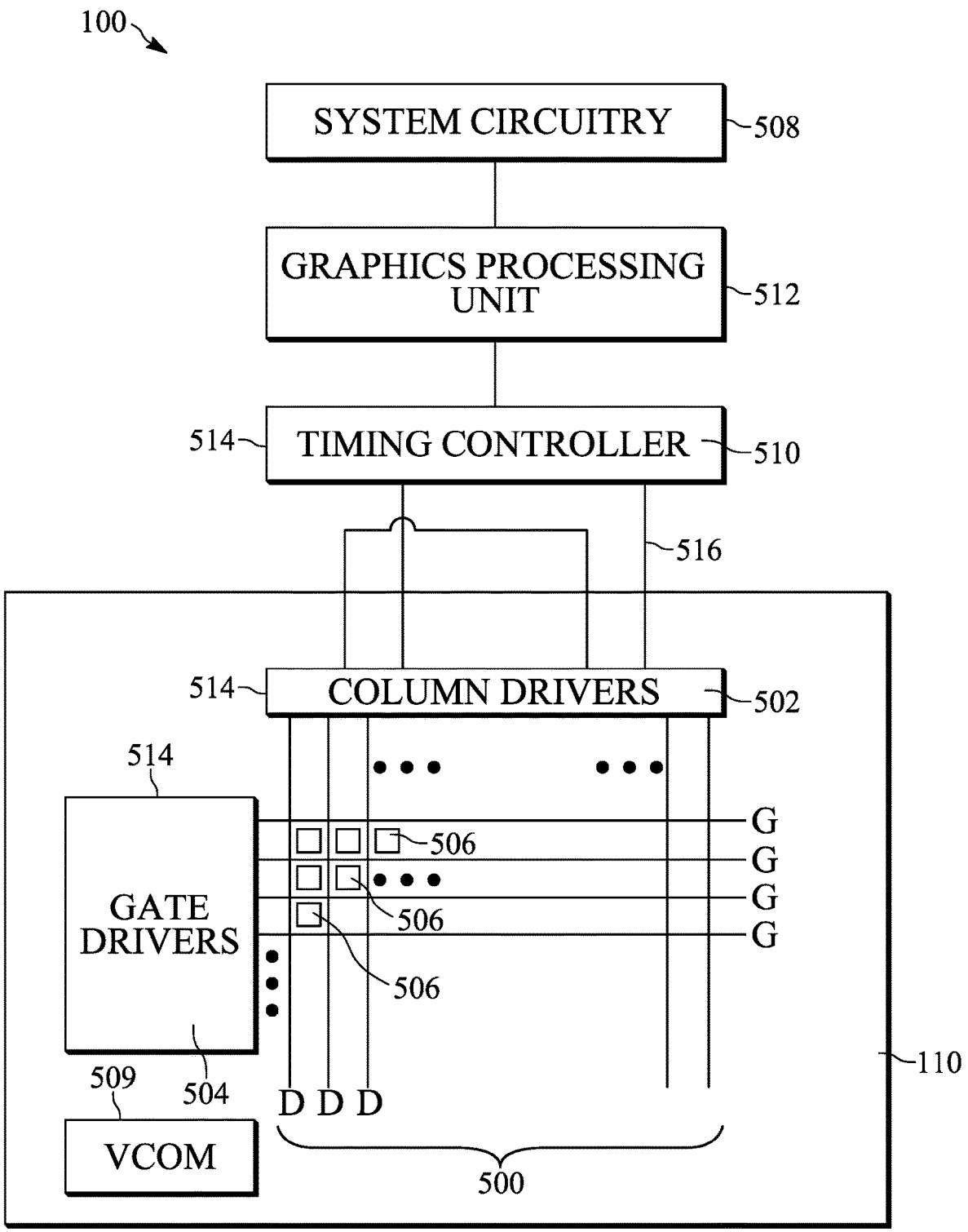
FIG. 5 illustrates a schematic diagram of an exemplary electronic device having a display in accordance with various aspects of the subject technology.

FIG. 5 is a schematic diagram of device 100 showing illustrative circuitry that may be used in displaying images for a user of device 100 on pixel array 500 of display 110. In the example of FIG. 5, display 110 includes column driver circuitry 502 that drives data signals (analog voltages) onto the data lines D of array 500. Gate driver circuitry 504 drives gate line signals onto gate lines G of array 500.

Using the data lines D and gate lines G, display pixels 506 are operated to display images on display 110 for a user. Operating a display pixel may include illuminating an LED of the display pixel or rotating the liquid crystals of a liquid crystal layer to allow backlight to pass through the liquid crystal layer. In some implementations, gate driver circuitry 504 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 502 may be implemented using one or more column driver integrated circuits that are mounted on the display substrate or using column driver circuits mounted on other substrates.

Device 100 includes control circuitry. The control circuitry includes system circuitry 508 and display control circuitry such as graphics processing unit 512, and timing controller 510. During operation of device 100, system circuitry 508 produces data that is to be displayed on display 110. This display data is provided to display control circuitry such as timing controller integrated circuit 510 using graphics processing unit 512.

Timing controller 510 provides digital display data, such as display pixel values for each display pixel, to column driver circuitry 502 using paths 516. Column driver circuitry 502 receives the digital display data from timing controller 510. Using digital-to-analog converter circuitry within column driver circuitry 502, column driver circuitry 502 provides corresponding analog output signals on the data lines D running along the columns of display pixels 506 of array 500.

Timing controller 510, column drivers 502, and gate drivers 504 may sometimes collectively be referred to herein as display control circuitry 514. Display control circuitry 514 is used in controlling the operation of display 110. Display control circuitry 514 may be implemented, in some configurations, in a common package such as a display driver, a display controller, a display driver integrated circuit (IC), or a driver IC. Graphics processing unit 512, when included in the display control circuitry, performs image or other graphics processing on display data received from system circuitry 508 prior to providing the display data to display control circuitry 514 for display using pixels 506 of array 500. Graphics processing unit 512 may be a separate processing controller from system circuitry associated with system circuitry 508 or may be implemented as a part of system circuitry 508 (e.g., in a common SOC).

Although a signal gate/scan line G and a single data line D for each pixel 506 are illustrated in FIG. 5, this is merely illustrative and one or more additional row-wise and/or column-wise control lines and/or supply lines may be coupled to each pixel 506 in various implementations. For example, a voltage supply mesh may be provided that is coupled to each of display pixels 506 and to a common supply voltage (VCOM) source. Gate drivers 504 select pixels 506 on a pixel row by pixel row basis, sequentially enabling the pixels 506 of a particular row for illumination. The illumination of the individual pixels in each row is controlled based on display data including display pixel values for each pixel (e.g., each colored sub pixel) in that row. Selecting the pixels of a pixel row and illuminating the individual pixels (e.g., by illuminating an LED or allowing backlight to pass through a liquid crystal layer) according to a display pixel value for each pixel is sometimes described herein as operating the display pixels.

Because the pixel values for the pixels each row are often different, the current sourced or sinked by the VCOM mesh changes with the operation of each pixel row. In order to limit the amount of VCOM current generated by the changing pixel values from row-to-row, the pixel values for each pixel row are monitored and may be modified to prevent a VCOM current above a threshold.

Figure 6:
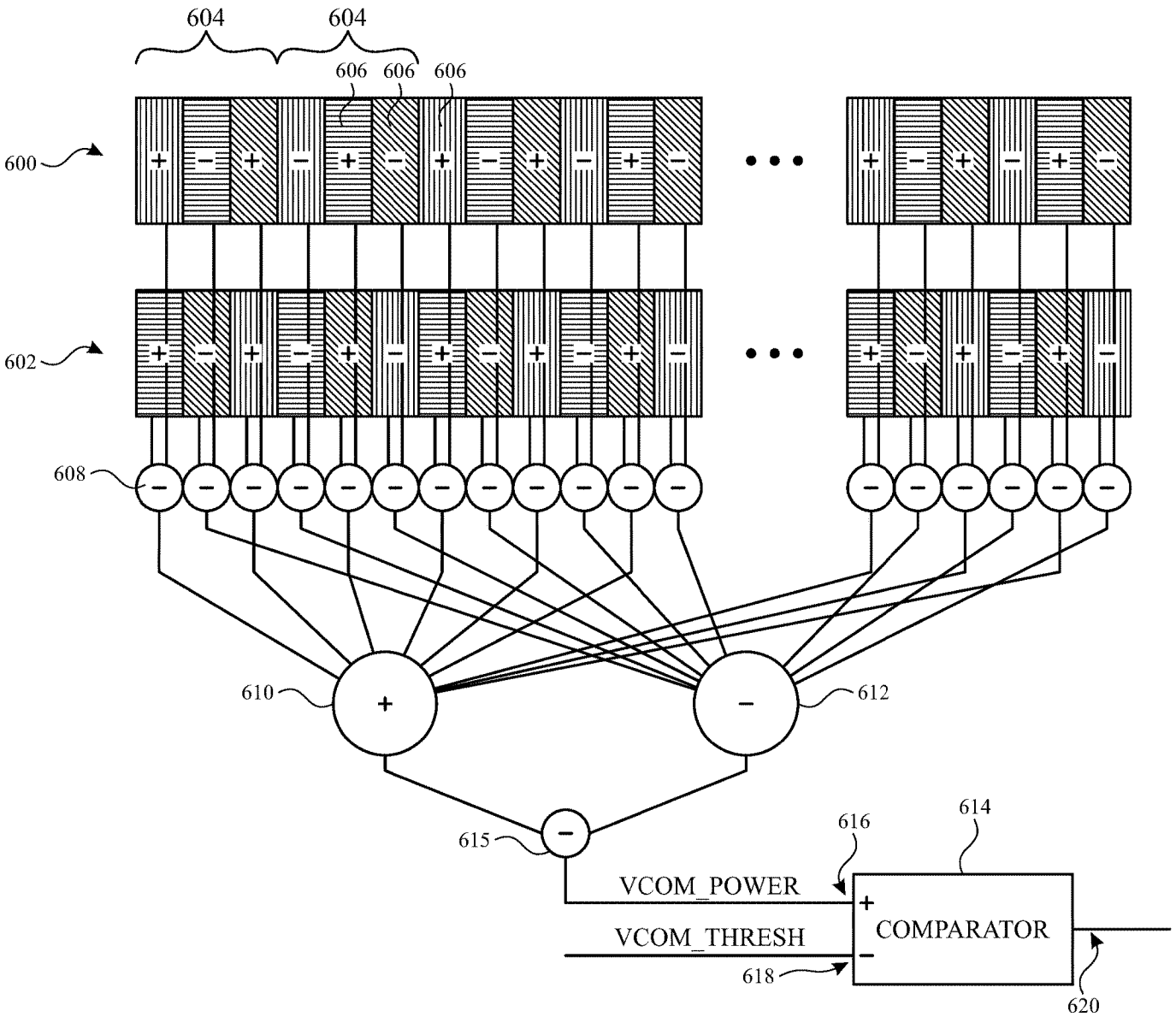
FIG. 6 illustrates a schematic diagram of circuitry for determining whether to enable VCOM current mitigation operations in accordance with various aspects of the subject technology.

FIG. 6 shows a schematic diagram of circuitry for monitoring pixel values to enable or disable VCOM overcurrent mitigation. FIG. 6 illustrates pixel values for a previous pixel row 600 and for a current pixel row 602. The display pixels of previous pixel row 600 are operated using the display pixel values shown. As shown, the pixel values for previous pixel row 600 may include subpixel values 606 for each of the display pixels 604 in that row. FIG. 6 also indicates that the pixel values of each pixel row may have a positive (+) polarity or a negative (−) polarity.

During operation of a display such as display 110, a corresponding common polarity pair of subpixel values, one each in previous row 600 and current row 602, are provided to a corresponding difference circuit 608 that determines the difference between those two pixel values. The subpixel differences for each pair of positive polarity pixel values are accumulated by a first accumulator 610. The subpixel differences for each pair of negative polarity pixel values are accumulated by a second accumulator 612. The accumulated differences from first accumulator 610 and second accumulator 612 are combined, by adder circuit 615, to determine a total differential VCOM power. The total differential VCOM power is provided from adder circuit 615 to a first input terminal 616 of comparator 614. A threshold VCOM power is provided to a second input terminal 618 of comparator 614. An output signal from comparator 614 is provided at output terminal 620. If the total differential VCOM power is greater than the threshold VCOM power, the output signal of comparator 614 enables VCOM current mitigation operations. If the total differential VCOM power is less than (or equal to) the threshold VCOM power, the output signal of comparator 614 disables or bypasses VCOM current mitigation operations.

As described in further detail in connection with FIGS. 7-9, VCOM current mitigation operations include replacing one or more of the pixel values (or subpixel values) of the current pixel row with replacement pixel values (or subpixel values) that reduce the total difference between the current pixel row values and the previous pixel row values and thereby reduce VCOM power generated by the switch from the previous to the current pixel row. The replacement pixel values (or subpixel values) can include a common replacement pixel value for all pixels (or subpixels) of the current pixel row, combinations (e.g., an average) of pixel values of neighboring pixels (or subpixels), or swapped pixel values of neighboring pixels (or sub pixels)

If replacement pixel values or subpixel values are generated, the current pixel row is then selected and the pixels are illuminated using the replacement pixel values or subpixel values instead of the original pixel values or subpixel values. Because the VCOM current depends on the actual pixel values used (e.g., drawn), the pixel values (or subpixel values) for the next pixel row are compared to the replacement pixel values (or subpixel values) for the current row to determine whether to enable or disable VCOM current mitigation operations for the next pixel row. The pixel value monitoring and VCOM current mitigation operations may be repeated for each adjacent pair of pixel rows and for each display frame during operation of the display.

Figure 7:
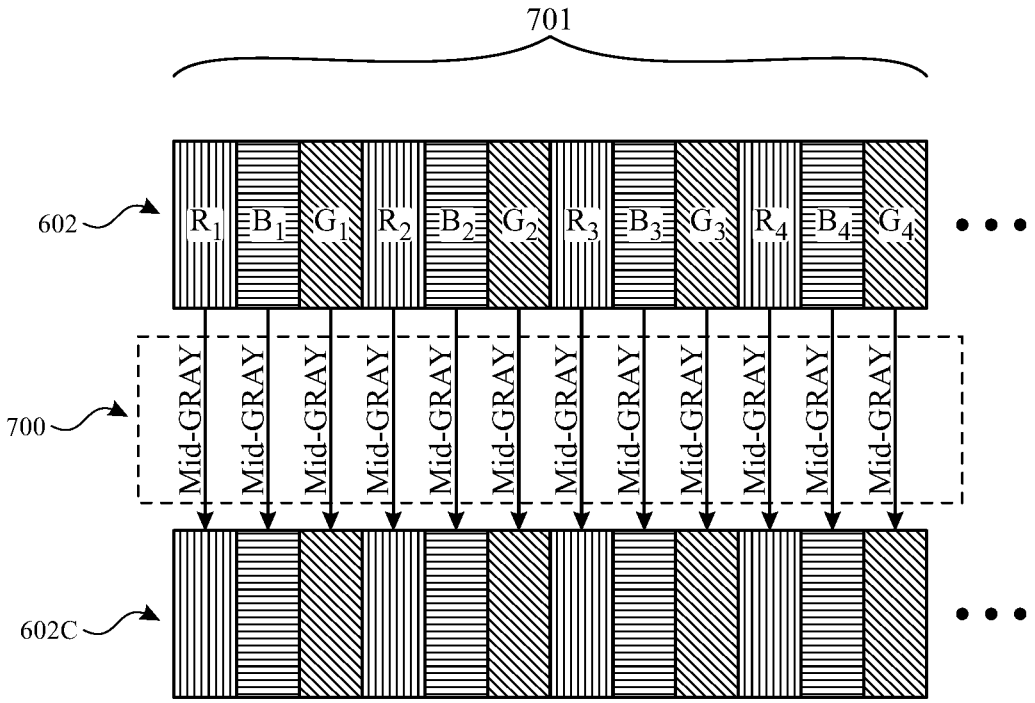
FIG. 7 illustrates a schematic diagram of a VCOM current mitigation operation in accordance with various aspects of the subject technology.

FIG. 7 schematically illustrates a process for VCOM current mitigation in which subpixel values for subpixels of multiple colors are replaced with a common replacement value. As shown, for a group 701 of subpixel values in current row 602, replacement subpixel values 700 that are all equal to a common value (denoted as "Mid-Grey" in FIG. 7) are used to generate a modified current row of subpixel values 602C for the current pixel row. Group 701 may include four pixels 604 (see FIG. 6), each having three colored subpixels as shown, or may include other numbers of pixels. The replacement subpixel values 700 may be the same for all subpixels in group 701. The replacement values 700 may be the same for all groups 701 in current pixel row 602 or may vary between groups.

In the example of FIG. 7, all of the original subpixel values of group 701 are replaced with modified subpixel values 700. However, it should be appreciated that the output of comparator 614 may be used to determine, for each group or each subpixel, whether the subpixel values are replaced with the modified subpixel values 700 or if the original subpixel values are used in modified current row of subpixel values 602C. Accordingly, modified row of subpixel values 602C may include original subpixel values and/or modified subpixels values 700 for various pixels in the current pixel row. The operations described in connection with FIG. 7 can be performed using two line buffers or can be performed, by increasing logic complexity, with a single line buffer in some implementations.

Following generation of modified row of subpixel values 602C, the current row of pixels 506 is selected and the pixels are illuminated using modified row of subpixel values 602C. The monitoring operations described above in connection with FIG. 6 are then repeated using modified row of subpixel values 602C as the subpixel values of the previous row for comparison with the subpixel values of the next pixel row. Modifying the subpixel values of the current pixel row with a common value as shown in FIG. 7 can reduce the VCOM current by as much as, for example, 50 percent. However, modifying the subpixel values of the current pixel row with a common value as shown in FIG. 7 can also create an undesirable visible effect on the display in some circumstances.

Figure 8:
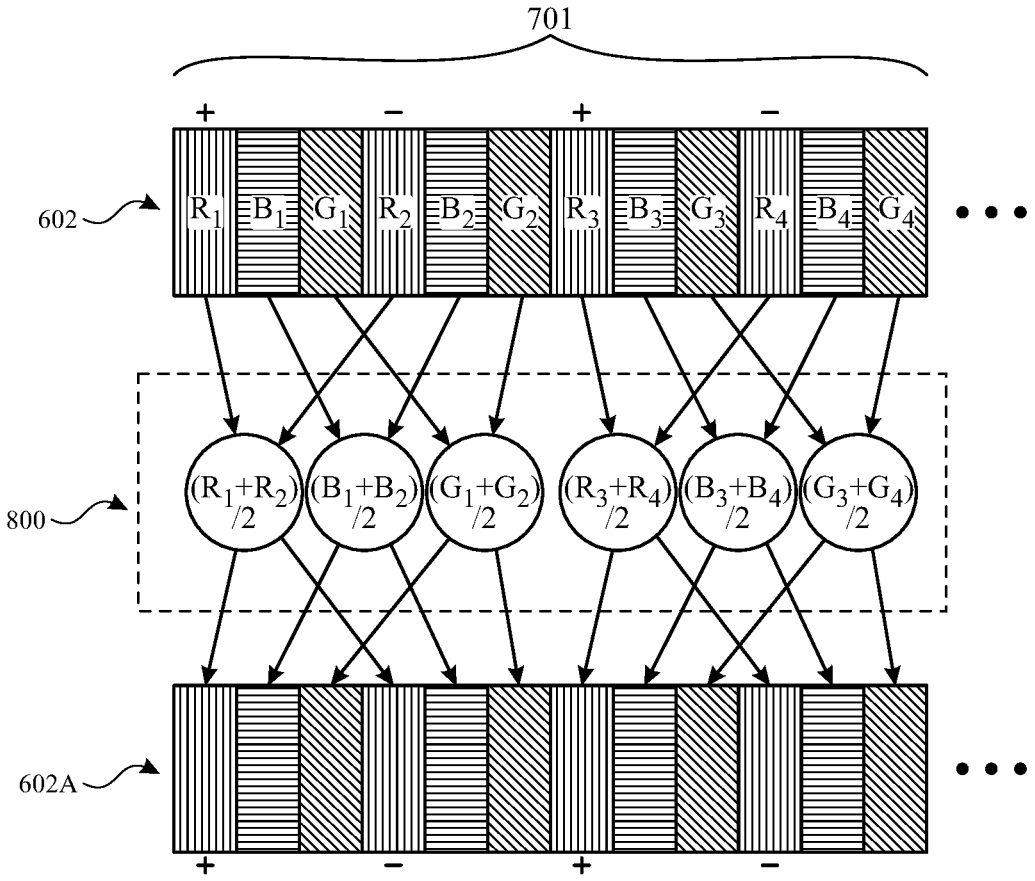
FIG. 8 illustrates a schematic diagram of another VCOM current mitigation operation in accordance with various aspects of the subject technology.

FIG. 8 schematically illustrates a process for VCOM current mitigation in which subpixel values of neighboring pixels are combined, if VCOM current mitigation is enabled. As shown in the example of FIG. 8, for a group 701 of subpixel values in current row 602, replacement subpixel values 800 are generated by averaging the subpixel values of each pair of neighboring subpixels and replacing the pixel values for both subpixels of the pair with the average of the pair to generate a modified current row of pixel values 602A for the current pixel row.

In the example of FIG. 8, all of the original subpixel values of group 701 are replaced with modified subpixel values 800. However, it should be appreciated that, the output of comparator 614 may be used to determine, for each group or each subpixel, whether the subpixels are replaced with the modified subpixel values 800 or if the original subpixel values are used in modified current row of subpixel values 602A. Accordingly, modified row of subpixel values 602A may include original subpixel values and/or modified subpixels values 800 for various pixels in the current pixel row. The operations described in connection with FIG. 8 can be performed using two line buffers or can be performed, by increasing logic complexity, with a single line buffer in some implementations.

Following generation of modified row of subpixel values 602A, the current row of pixels 506 is selected and the pixels are illuminated using modified row of subpixel values 602A. The monitoring operations described above in connection with FIG. 6 are then repeated using modified row of subpixel values 602A as the subpixel values of the previous row for comparison with the subpixel values of the next pixel row. Modifying the subpixel values of the current pixel row with neighbor-averaged values as shown in FIG. 8 can reduce the VCOM current by as much as, for example, 50 percent and may have a less noticeable visual effect on the display than using a common replacement values as described in connection with FIG. 7. However, modifying the subpixel values of the current pixel row with neighbor-averaged values still changes the displayed values and can therefore also create an undesirable visible effect on the display in some circumstances.

Figure 9:
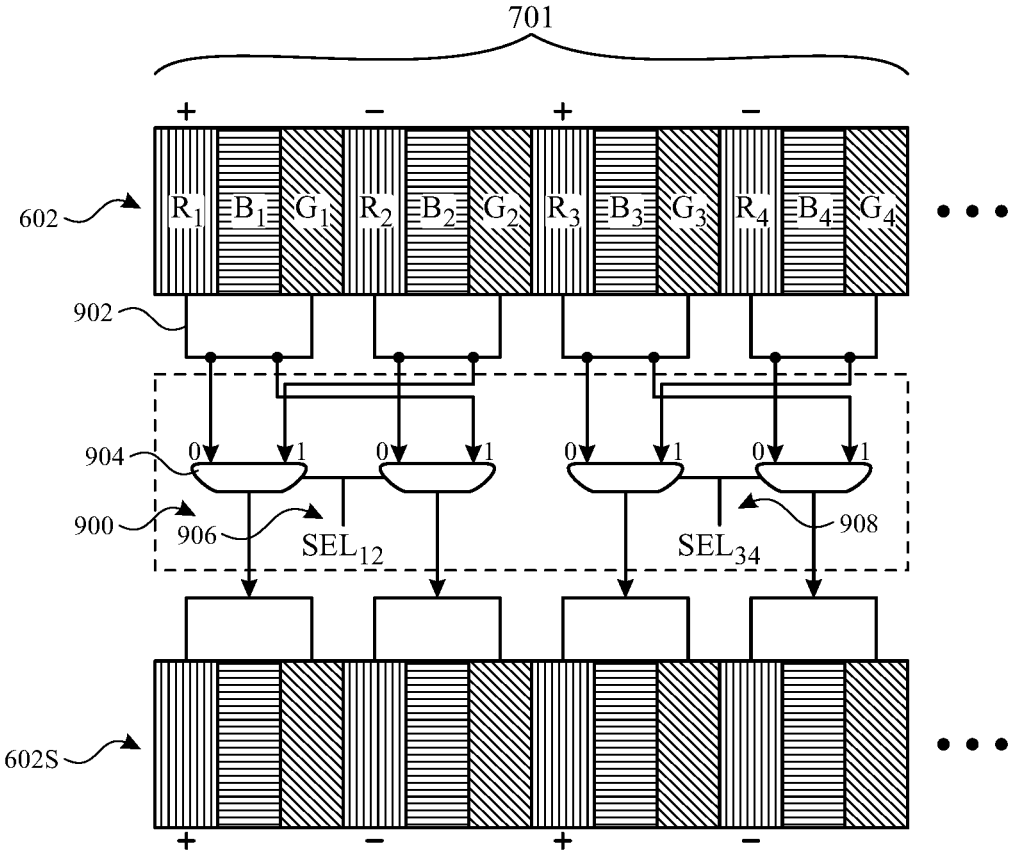
FIG. 9 illustrates a schematic diagram of another VCOM current mitigation operation in accordance with various aspects of the subject technology.

FIG. 9 schematically illustrates a process for VCOM current mitigation in which subpixel values of neighboring pixels are swapped, if VCOM current mitigation is enabled, and if the swap reduces the VCOM current. The neighboring pixels may be opposite in polarity. As shown in the example of FIG. 9, for a group 701 of subpixel values in current row 602, replacement subpixel values 900 are generated by swapping the subpixel values of each pair of neighboring subpixels, to generate a modified current row of pixel values 600S for the current pixel row.

In the example of FIG. 9, subpixel values for neighboring subpixels of the same color are provided, via paths 902 to a multiplexer 904, along with a selection signal 906 (e.g., $SEL_{12}$ or $SEL_{34}$) for that pair of subpixels. Based on the selection signal, the multiplexer outputs the original subpixel values or swapped subpixel values. Selection signals $SEL_{12}$ and $SEL_{34}$ are based on the output signal from comparator 614. For each group 701 of pixels, if the output of comparator 614 is a mitigation disable signal (e.g., if the total differential VCOM power is less than or equal to the threshold), mitigation operations are bypassed for that group. If the output of comparator 614 is a mitigation enable signal (e.g., if the total differential VCOM power is greater than the threshold), mitigation operations are performed for that group.

In the example of FIG. 9, mitigation operations include determining, for each pair of subpixels in each group of pixels, if swapping of neighboring pairs of subpixel values lowers the total differential VCOM power. If swapping of the neighboring pairs of subpixel values lowers the total differential VCOM power, the mitigation operations include swapping the subpixel values. If swapping of the neighboring pairs of subpixel values does not lower the total differential VCOM power, the mitigation operations include throughputting the original subpixel values.

Determining whether swapping of the neighboring pairs of subpixel values lowers the total differential VCOM power includes re-computing the total differential VCOM power with the swapped values and comparing the recomputed total differential VCOM power with the previously computed total differential VCOM power. The operations described in connection with FIG. 9 can be performed using two line buffers.

Following generation of modified row of subpixel values 602S, the current row of pixels 506 is selected and the pixels are illuminated using modified row of subpixel values 602S. The monitoring operations described above in connection with FIG. 6 are then repeated using modified row of subpixel values 602S as the subpixel values of the previous row for comparison with the subpixel values of the next pixel row. Modifying the subpixel values of the current pixel row with neighbor-swapped values as shown in FIG. 9 can reduce the VCOM current by as much as or more than, for example, 50 percent, and may have a less noticeable visual effect on the display than using common replacement values or neighbor-averaged values as described in connection with FIGS. 7 and 8 because no color or brightness changes are made to the set of pixel values in each line.

In the example of FIG. 9, the swap is performed only if the swap is beneficial with respect to reducing the VCOM current. However, in some scenarios, this conditional swapping can lead to unwanted visible artifacts. For example, if a static image with a repeating pattern is displayed, the last column in which a swap is performed can turn out to be the same for multiple rows of pixels. This can generate a visible line along that column that may be undesirable.

In order to mitigate and/or eliminate these unwanted visible artifacts, various modifications to the swapping operations of FIG. 9 may be made. For example, a spatial dithering of the last column in which a swap is performed may be used. In this example, the last column in which a swap is performed for a given row may be modified by a dithering value (e.g., moved by a value of between +/−128 pixels or between +/−256 pixels) using (for example) a linear-feedback shift register (LFSR), even at the expense of additional VCOM current. The dithering value is varied so that the last modified column in each row is different. In this way, the VCOM current is reduced relative to an operation without swapping, but the likelihood of visible artifacts due to the swapping is reduced.

In another example, spatial and temporal dithering may be performed in combination with the pixel value swapping as described in FIG. 9. In a spatial and temporal dithering operation, the spatial dithering as described above for the lines of a single frame is performed, and the dithering values, for a particular line, between frames, are also varied. In this way, a visible artifact associated with a dithering pattern in a static image with repeating patterns can be avoided.

In another example, the condition of reducing the VCOM current for a particular pair of pixels to be swapped can be eliminated. In this example, if it is determined that the expected VCOM power for a pair of pixel rows is greater than the VCOM threshold, the neighboring pixel values of the same color in the current row can be swapped across the entire row. Although swapping neighboring pixel values across the entire row can limit the reduction in VCOM current to a 50 percent reduction, a 50 percent reduction, in combination with the lack of any visible artifacts associated with the swapping and/or with a dithering pattern, can be provide a balance of benefits in power reduction and front-of-screen performance.

In accordance with various aspects of the subject disclosure, an electronic device display is provided that includes an array of display pixels arranged in rows and columns. The display also includes control circuitry for the array of display pixels. The control circuitry is configured to illuminate each display pixel in a first row of display pixels based on a display pixel value for that display pixel. The control circuitry is also configured to receive a display pixel value for each display pixel in a second row of display pixels. The control circuitry is also configured to determine a difference between the display pixel value for each display pixel in the second row and the display pixel value for a corresponding display pixel in the first row. The control circuitry is also configured to determine a total of the determined differences. The control circuitry is also configured to compare the total of the determined differences to a threshold. The control circuitry is also configured to determine whether to modify the display pixel values for the second row of display pixels based on the comparison.

In accordance with other aspects of the subject disclosure, a method is provided that includes determining, based on pixel values for a row of display pixels in an electronic device display, that a current in common supply voltage circuitry for the display pixels will exceed a threshold if the row of display pixels is illuminate using the pixel values. The method also includes modifying the pixel values for the row of display pixels to prevent the current in the common supply voltage circuitry from exceeding the threshold.

In accordance with other aspects of the subject disclosure, an electronic device having a display is provided, the display including an array of display pixels arranged in rows and columns and control circuitry for the array of display pixels. The control circuitry is configured to determine, based on pixel values for display with a first one of the rows, that a current in common supply voltage circuitry for the array of display pixels will exceed a threshold if the first one of the rows is operated using the pixel values. The control circuitry is also configured to modify the pixel values for the first one of the rows to prevent the current in the common supply voltage circuitry from exceeding the threshold.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device with a display, the display comprising:

an array of display pixels arranged in rows and columns; and control circuitry for the array of display pixels, the control circuitry configured to:

illuminate each display pixel in a first row of display pixels based on a display pixel value for that display pixel;

receive a display pixel value for each display pixel in a second row of display pixels;

determine a difference between the display pixel value for each display pixel in the second row and the display pixel values for a corresponding display pixel in the first row;

determine a total of determined differences for pairs of positive polarity display pixels in the first and second rows;

determine a total of determined differences for pairs of negative polarity display pixels in the first and second rows;

combining the total of the determined differences for the pairs of positive polarity display pixels and the total of the determined differences for the pairs of negative polarity display pixels to determine a total sum of the determined differences between the display pixel value for each display pixel in the second row and the display pixel value for a corresponding display pixel in the first row;

compare the total sum of the determined differences to a threshold for a common voltage that is supplied to the display pixels;

determine whether to modify the display pixel values for the second row of display pixels based on the comparison of the total sum of the determined differences to the threshold; and enabling mitigation of current for the common voltage when modifying the display pixel values for the second row of display pixels.

2. The electronic device of claim 1, wherein the first and second rows of display pixels each include positive polarity display pixels and negative polarity display pixels, and wherein the control circuitry is configured to determine the total of the determined differences by:

determining a total of the determined differences for pairs of positive polarity display pixels in the first and second rows;

determining a total of the determined differences for pairs of negative polarity display pixels in the first and second rows; and combining the total of the determined differences for the pairs of positive polarity display pixels and the total of the determined differences for the pairs of negative polarity display pixels.

3. The electronic device of claim 2, wherein the control circuitry is further configured to modify the display pixel values for the second row of display pixels by setting all of the display pixel values for the second row of display pixels to a common value.

4. The electronic device of claim 2, wherein the control circuitry is further configured to modify the display pixel values for the second row of display pixels by replacing pairs of display pixel values corresponding to neighboring display pixels in the second row with an average of that pair of display pixel values.

5. The electronic device of claim 2, wherein the control circuitry is further configured to modify the display pixel values for the second row of display pixels by swapping pairs of display pixel values corresponding to neighboring display pixels in the second row.

6. The electronic device of claim 1, wherein the first and second rows are adjacent rows of display pixels.

7. The electronic device of claim 1, wherein the control circuitry is further configured to:

modify the display pixel values for the second row;

illuminate each display pixel in the second row based on a modified display pixel value for that display pixel;

receive a display pixel value for each display pixel in a third row of display pixels;

determine a new difference between the modified display pixel value for each display pixel in the second row and the display pixel value for a corresponding display pixel in the third row;

determine a new total of the determined new differences;

compare the new total of the determined new differences to the threshold; and determine whether to modify the display pixel values for the third row of display pixels based on the comparison of the new total of the determined new differences to the threshold.

8. A method of operating an electronic device, the method comprising:

determining a total of determined differences for pairs of positive polarity display pixels in first and second rows of an array of display pixels;

determining a total of determined differences for pairs of negative polarity display pixels in the first and second rows;

combining the total of the determined differences for the pairs of positive polarity display pixels and the total of the determined differences for the pairs of negative polarity display pixels to determine a total sum of the determined differences between the display pixel value for each display pixel in the second row and the display pixel value for a corresponding display pixel in the first row;

determining, based on the total sum of the determined differences, that a current in common supply voltage circuitry for the display pixels in the second row will exceed a threshold for a common voltage of the common supply voltage circuitry that is supplied to the display pixels if the second row of display pixels is illuminated using the pixel values; and modifying the pixel values for the second row of display pixels to enable mitigation of current to prevent the current in the common supply voltage circuitry from exceeding the threshold for the common voltage of the common supply voltage circuitry.

9. The method of claim 8, wherein modifying the pixel values comprises replacing the pixel values with a common pixel value.

10. The method of claim 8, wherein modifying the pixel values comprises replacing each pixel value in each of a plurality of pairs of the pixel values with an average of the pixel values of that pair of the pixel values.

11. The method of claim 8, wherein modifying the pixel values comprises swapping the pixel values in each of a plurality of pairs of the pixel values, if the swapping reduces the current.

12. The method of claim 8, wherein the determining comprises comparing the pixel values for the row of display pixels with pixel values for a previously illuminated row of display pixels in the electronic device display.

13. The method of claim 8, wherein each of the pixel values comprises a subpixel value for a colored subpixel in the row of display pixels.

14. The method of claim 8, further comprising illuminating the row of display pixels using the modified pixel values.

15. An electronic device having a display, the display comprising:

an array of display pixels arranged in rows and columns; and control circuitry for the array of display pixels, the control circuitry configured to:

determine a total of determined differences for pairs of positive polarity display pixels in first and second rows of the array of display pixels;

determine a total of determined differences for pairs of negative polarity display pixels in the first and second rows;

combining the total of the determined differences for the pairs of positive polarity display pixels and the total of the determined differences for the pairs of negative polarity display pixels to determine a total sum of the determined differences between the display pixel value for each display pixel in the second row and the display pixel value for a corresponding display pixel in the first row;

determine, based on the total sum of the determined differences, that a current in common supply voltage circuitry for the array of display pixels in the first row will exceed a threshold for a common voltage of the common supply voltage circuitry that is supplied to the display pixels if the first row is operated using the pixel values; and modify the pixel values for the first row to enable mitigation of current to prevent the current in the common supply voltage circuitry from exceeding the threshold for the common voltage of the common supply voltage circuitry.

16. The electronic device of claim 15, wherein the control circuitry comprises:

a plurality of difference circuits, each configured to determine a difference between one of the pixel values for display with the first row and a corresponding pixel value for display with a second row;

at least one accumulator configured to determine a total of the determined differences; and a comparator configured to:

compare the total of the determined differences to the threshold, and determine that the pixel values for the first row are to be modified based on the comparison.

17. The electronic device of claim 16, wherein the first row and the second row include positive polarity display pixels and negative polarity display pixels, and wherein the at least one accumulator comprises:

a first accumulator configured to determine a total of the determined differences for pairs of positive polarity display pixels in the first row and the second row; and a second accumulator configured to determine a total of the determined differences for pairs of negative polarity display pixels in the first row and the second row, and wherein the control circuitry further comprises an adder configured to combine the total of the determined differences for the pairs of positive polarity display pixels from the first accumulator and the total of the determined differences for the pairs of negative polarity display pixels from the second accumulator.

18. The electronic device of claim 16, wherein the control circuitry is configured to modify the pixel values by replacing at least some of the pixel values with a common pixel value.

19. The electronic device of claim 16, wherein the control circuitry is configured to modify the pixel values by replacing each pixel value in each of a plurality of pairs of the pixel values with an average of the pixel values of that pair of the pixel values.

20. The electronic device of claim 16, wherein the control circuitry is configured to modify the pixel values by swapping the pixel values in each of a plurality of pairs of the pixel values, if the swapping reduces the current.

* * * * *